US008539654B2

(12) United States Patent
Skov

(10) Patent No.: US 8,539,654 B2
(45) **Date of Patent: *Sep. 24, 2013**

(54) COFFIN, WHICH HAS KINDLY ENVIRONMENT MEANS

(75) Inventor: Bendt Skov, Copenhagen Ø (DK)

(73) Assignee: Beco Consult APS, Copenhagen O (DK)

( * ) Notice: Subject to any disclaimer, the term of this patent is extended or adjusted under 35 U.S.C. 154(b) by 0 days.

This patent is subject to a terminal disclaimer.

(21) Appl. No.: 13/254,973

(22) PCT Filed: Sep. 18, 2009

(86) PCT No.: PCT/DK2009/000207

§ 371 (c)(1),
(2), (4) Date: Sep. 6, 2011

(87) PCT Pub. No.: WO2010/102622

PCT Pub. Date: Sep. 16, 2010

(65) Prior Publication Data

US 2011/0314648 A1 Dec. 29, 2011

(30) Foreign Application Priority Data

Mar. 7, 2009 (DK) ..... BA 2009 00049

(51) Int. Cl.
*A61G 17/00* (2006.01)

(52) U.S. Cl.
USPC ..... 27/14; 27/4; 229/125.01

(58) Field of Classification Search
USPC ..... 27/2, 4, 14, 19, 17; 229/199, 117.01, 229/125.01
See application file for complete search history.

(56) References Cited

U.S. PATENT DOCUMENTS

| | | | | |
|---|---|---|---|---|
| 1,065,579 | A | 6/1913 | Bentley et al. | |
| 1,497,375 | A * | 6/1924 | Knox | 27/6 |
| 1,705,410 | A * | 3/1929 | Laidlaw | 27/35 |
| 3,934,790 | A * | 1/1976 | Easter | 229/119 |
| 4,018,338 | A * | 4/1977 | Lemkin | 206/505 |
| 4,209,880 | A * | 7/1980 | Lidholm | 27/2 |
| 4,253,206 | A * | 3/1981 | Cherry | 5/600 |
| 4,730,370 | A * | 3/1988 | Elder | 27/4 |
| 4,749,097 | A * | 6/1988 | Rosman | 220/4.21 |
| 4,967,455 | A * | 11/1990 | Elder | 27/4 |
| 5,307,545 | A * | 5/1994 | Stoltz | 27/4 |
| 5,485,661 | A * | 1/1996 | McClure | 27/7 |
| 5,690,274 | A * | 11/1997 | Yang | 229/117 |
| 5,740,592 | A * | 4/1998 | Lau | 27/4 |
| 6,145,175 | A * | 11/2000 | Enneking et al. | 27/4 |
| 6,317,943 | B1 * | 11/2001 | Wood | 27/4 |
| 6,694,579 | B2 * | 2/2004 | Belanger et al. | 27/4 |
| 6,725,510 | B1 * | 4/2004 | Clyburn | 27/12 |
| 8,079,119 | B1 * | 12/2011 | Ferko, III | 27/4 |

FOREIGN PATENT DOCUMENTS

| | | |
|---|---|---|
| DE | 195 16 500 A1 | 11/1996 |
| DK | 2000 00282 U3 | 12/2000 |

* cited by examiner

*Primary Examiner* — William Miller
(74) *Attorney, Agent, or Firm* — Nath, Goldberg & Meyer; Jerald L. Meyer

(57) ABSTRACT

Coffin (2), which in its shape, function and its choice of material has a kind environment, but still is stabile, and with a lit (1), which in its design has means (7) for by an earth filling (6) to be able to be discharge (5) in to the coffin (2) and down against the body (4) there has to be buried, as the lid (1) in its edges (3) has a folding arrangement (7).

14 Claims, 1 Drawing Sheet

COFFIN, WHICH HAS KINDLY ENVIRONMENT MEANS

This is a National Phase Application filed under 35 U.S.C. 371 as a national stage of PCT/DK2009/000207, filed 18 Sep. 2009, and claiming the benefit from Danish Application No. BA 2009 00049, filed Mar. 7, 2009, the content of which is hereby incorporated by reference in its entirety.

BACKGROUND

1. Field

The present disclosure relates to a coffin, which in its design, function and in its choice of material is environmentally-friendly.

2. Background

Hitherto it is known to have coffin, where there is shown a two spited coffin, with an outer an inner coffin, but first after that one has dismounted one or more vertical placed holding—or distance plugs between the two coffins. An example is represented by Danish Utility Model DK 2000 00282.

The disadvantage is that the configuration uses wood, which in this version is expensive, and that it only very difficult over time for it to disintegrate by putrefaction, which very well could last half to a whole year. Additionally, subsequent to burial, it becomes necessary to add additional earth, because the earth sinks as a result of crushing of the coffin.

The disadvantage is, unless one uses an inner coffin and a outer coffin (vault), and even when using the two coffins, then collapse of the lid by displacement into the coffin can be difficult, and the coffin will not be able to immediately be shaped into a compact form and be drawn down tight over the body.

With the invention one want to make an arrangement of coffin, of the mentioned sort, where one for the first can establish or make an arrangement of coffin, which is essential cheaper than earlier, in the same time with that this by this will be more environmentally friendly, and where it by its design has such a function, that one generally can avoid causing the earth on the place of burial to sink after some time following the funeral.

SUMMARY

A coffin is configured with a lid which, upon backfilling with earth is able to be displaced or collapse into the coffin, and down against the body, as a result of the lid having, in its edges, folding arrangements.

DETAILED DESCRIPTION

The described configuration permits the lid, upon backfilling with earth, with a reasonable mass and inertia from the mass will collapse the lid of the coffin and cause the lid to be displaced into the coffin itself. The mass from required to collapse the lid of the coffin would surpass that expected to be present from the force and weight resulting from laying of flowers and the like. In one configuration, the folding arrangement has the general configuration of an accordion bellows.

As a result of downward pressure on the top of the lid and the sides, the lid will be able to be moved and collapse along the bellows. This will especially work, when one throw earth on the lid, by which the inertia of the earth or the moving energy applied to the lid and the arrangement of the bellow, which causes these to be pushed and guided down in to the coffin and over the body itself.

In one configuration, the bottom of the coffin is equipped with U-shaped running ribs. This provides that the coffin itself will be stabilised for bending and cracking. In one particular configuration, the sides of the coffin are equipped with vertically-arranged U-shaped ribs. As a result, the sides on the coffin do not will be able to fold together in vertical direction, but will be more stabilised.

In one particular configuration the box itself of the coffin is made in more sections as two identical sections which are then coupled together, or three sections, which are then coupled together with a middle section, and where the ends are identical.

The disclosed configuration permits less costly moulds for paper pulp, as the mould will be identical for the two ends, and at the same time the mould will be shorter, which also applies for a middle section, if the coffin is made of three sections. The coffin in this way can also be provided in two different lengths, with and without a middle section.

In one particular configuration, the arrangement of the coffin may be made of paper pulp or like perishable material or recycled material.

The disclosed configuration provides that the coffin both will be less costly in production, and in the same time with that it will rapidly deteriorate. This arrangement will further be more environmentally-friendly.

Figure 1:
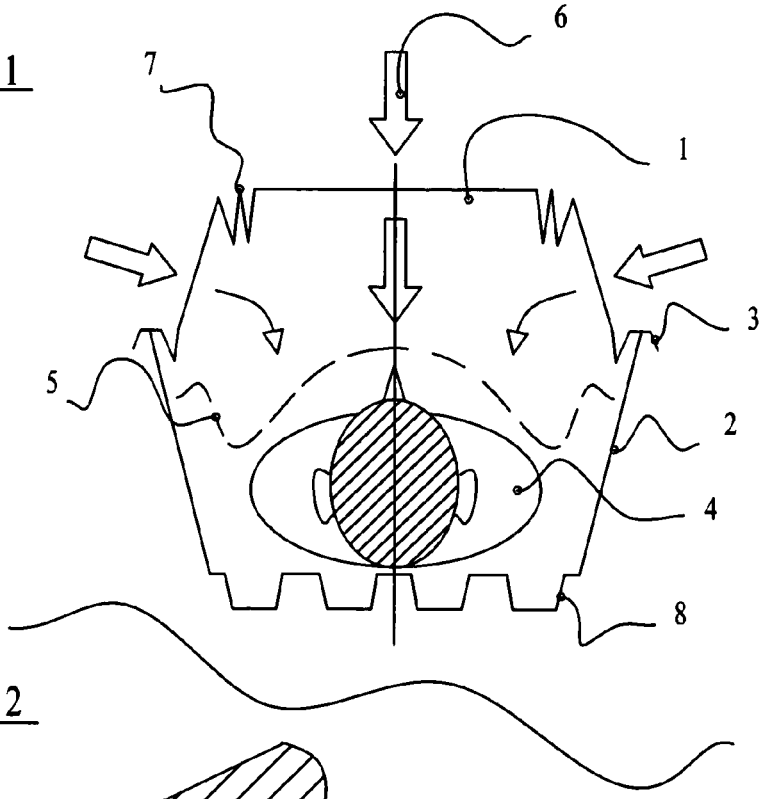
FIG. 1 is a diagram showing, in a sectional view, a coffin, which permit the lid to collapse over the decedent upon backfilling of the grave with earth.

FIG. 1 is a diagram showing a coffin 2, where there in this 2 is a body 4, and where one can see, how the lid 1 by a filling with earth 6 collapses down and around above the deceased person 4.

It can be seen very clearly, how one has made the lid 1, so that lid 1 itself automatically, by the filling with earth 6, will collapse down into the coffin 2, and fold up around 5 and over the deceased person 4. From the drawing one can also see, how the lid 1 on the edge 3 has a down going board 3, which guides the lid 1 so that it 1 in the first time do not will slip the sides 10.

The lid 1 could, if necessary, also be equipped with a locking or latching arrangement, similar to the arrangement of egg cartons, where one close the eggs box by use of tabs, which can be pushed into corresponding holes.

In the lid 1, according to one alternative, it is possible to place pins through the bellows 7, so that even a heavy laying 6 of flowers on lid 1 of the coffin 2 would not displace the lid 1 down into the coffin itself 2.

Alternatively, a locking arrangement may be used a 1á the above-mentioned egg carton tabs.

The bottom could also be equipped with profiles 8 with long going ribs 8, which would provide some stability to the body of the coffin 2 itself, and specially, if the coffin 2 is lifted with weight 4 in it 2. It is possible to mount two longitudinal beams out on, at the edges, or between ribs 11, with these longitudinal beams laid respectively in the right as in the left side. The handles for lift could ideally so be mounted on these beams.

The beams could even be removed when the coffin 2 has been lowered into the grave, for example by removing the handles out to each sides. One could also leave the handles in place. Alternatively, one make longitudinal beams from millboard or paper or like.

Figure 2:
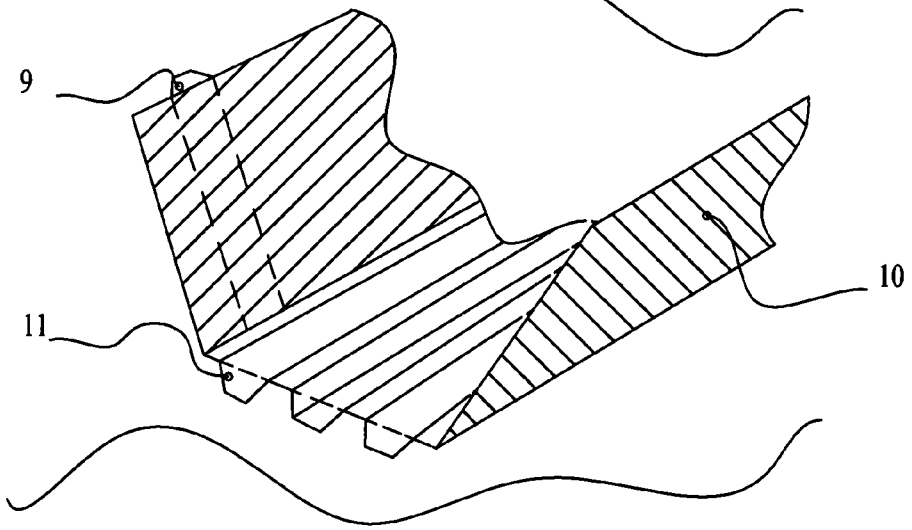
FIG. 2 is a diagram showing, in a sectional view, and in perspective a profile of the coffin.

FIG. 2 is a diagram showing a profile of the coffin 2, and where one clearly here can see the long going profiles 11 or ribs 11 in the bottom, and the vertical profiles 9 or ribs 9 on the sides of the coffin 2. The profiles 8, 9 and 11, as earlier mentioned, assure that the coffin 2 itself will be more stabile, and that it 2 can hold to be lifted with a load 4, without being prone to collapse or to breakage.

Figure 3:
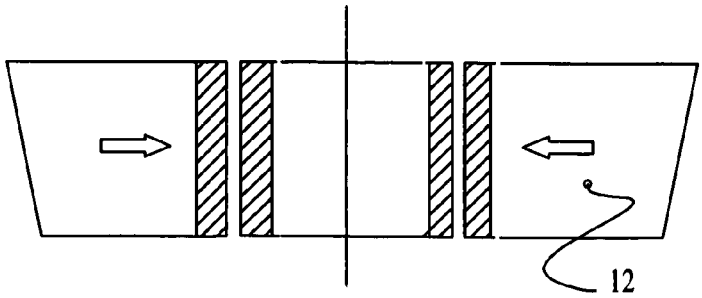
FIG. 3 is a diagram showing, in a side view, a coffin made of three sections.

FIG. 3 is a diagram showing, as seen form the side, a coffin 2 made of three sections 12, where the two end-parts generally are identical, and where the middle part links the coffin 2 together.

The invention claimed is:

1. A coffin, constructed of an environmentally friendly material, the coffin comprising:

a coffin box and a lid where the lid is formed having peripheral edges that abut and extend beyond side walls of the coffin box and wherein the lid extends uninterrupted from one side wall of the coffin box to the other side wall of the coffin box, wherein the lid is provided with displacing means, so that the lid is adapted to displace into an inner volume of the coffin box upon placement of earth fillings on top of the coffin lid during burial and the lid is adapted to fold onto a body that is to be buried, and wherein the displacing means comprises a folding arrangement allowing the lid to extend into the inner volume of the coffin box while maintaining a connection with the side walls of the coffin box, wherein the folding arrangement is shaped as an accordion bellows.

2. A coffin according to claim 1, wherein a bottom of the coffin box comprises U-shaped ribs ex-tending along a longitudinal axis of the coffin box.

3. A coffin according to claim 2, wherein the coffin box comprises two or more equal end sections, that are assembled.

4. A coffin according to claim 2, wherein the coffin box comprises three sections, in the form of two end sections that are assembled together with a middle section.

5. A coffin according to claim 4, wherein the environmentally friendly material comprises paper pulp or similar perishable or waste material.

6. A coffin according to claim 1, wherein the side walls of the coffin box are provided with vertical U-shaped ribs.

7. A coffin according to claim 1, wherein the coffin box is made of a plurality of equal sections.

8. A coffin, constructed of an environmentally friendly material, the coffin comprising:

a coffin box and a lid where the lid is formed having peripheral edges that abut and extend beyond side walls of the coffin box and wherein the lid extends uninterrupted from one side wall of the coffin box to the other side wall of the coffin box, wherein the lid is provided with displacing means, so that the lid is adapted to displace into an inner volume of the coffin box upon placement of earth fillings on top of the coffin lid during burial and the lid is adapted to fold onto a body that is to be buried, wherein the displacing means comprises a folding arrangement allowing the lid to extend into the inner volume of the coffin box while maintaining a connection with the side walls of the coffin box, and wherein the folding arrangement comprising the displacement means is provided in an area of the lid that is distal from the connection with the side walls of the coffin box.

9. A coffin according to claim 8, wherein a bottom of the coffin box comprises U-shaped ribs extending along a longitudinal axis of the coffin box.

10. A coffin according to claim 8, wherein the side walls of the coffin box are provided with vertical U-shaped ribs.

11. A coffin according to claim 8, wherein the coffin box is made of a plurality of equal sections.

12. A coffin according to claim 11, wherein the coffin box comprises two or more equal end sections, that are assembled.

13. A coffin according to claim 11, wherein the coffin box comprises three sections, in the form of two end sections that are assembled together with a middle section.

14. A coffin according to claim 13, wherein the environmentally friendly material comprises paper pulp or similar perishable or waste material.

* * * * *

UNITED STATES PATENT AND TRADEMARK OFFICE

CERTIFICATE OF CORRECTION

PATENT NO. : 8,539,654 B2
APPLICATION NO. : 13/254973
DATED : September 24, 2013
INVENTOR(S) : Bendt Skov It is certified that error appears in the above-identified patent and that said Letters Patent is hereby corrected as shown below:

On the title page under (*) Notice line 4,

Please delete: "This patent is subject to a terminal disclaimer."

Signed and Sealed this
Twenty-sixth Day of November, 2013

Margaret A. Focarino

Margaret A. Focarino
*Commissioner for Patents of the United States Patent and Trademark Office*